US005212525A

United States Patent [19]

Noami et al.

[11] Patent Number: 5,212,525

[45] Date of Patent: May 18, 1993

[54] DEVELOPING MAGNETIC ROLLER HAVING REPULSIVE MAGNETIC POLES AND DEVELOPER-LIMITING MEMBER

[75] Inventors: Tsuneo Noami; Takeshi Sumikawa; Nobumasa Furuya, all of Ebina, Japan

[73] Assignee: Fuji Xerox Co., Ltd., Tokyo, Japan

[21] Appl. No.: 773,849

[22] Filed: Oct. 11, 1991

[30] Foreign Application Priority Data

Oct. 25, 1990 [JP] Japan ..... 2-288045
Sep. 30, 1991 [JP] Japan ..... 3-276372

[51] Int. Cl.[5] ..... G03G 15/09

[52] U.S. Cl. ..... 355/251; 118/657; 118/658; 355/259

[58] Field of Search ..... 355/245, 251, 253, 259; 118/656, 657, 658

[56] References Cited

U.S. PATENT DOCUMENTS 4,492,456 1/1985 Haneda et al. ..... 355/256
4,625,676 12/1986 Sakamoto et al. ..... 118/657
4,637,706 1/1987 Hosoi et al. ..... 118/658
4,959,692 9/1990 Hayashi et al. ..... 355/253

FOREIGN PATENT DOCUMENTS 54-43037 5/1979 Japan .
54-43038 5/1979 Japan .
60-203975 10/1985 Japan .
62-184484 8/1987 Japan .
62-234177 10/1987 Japan .

*Primary Examiner*—A. T. Grimley
*Assistant Examiner*—Nestor R. Ramirez

[57] ABSTRACT

There is disclosed a dual component developing device for developing an electrostatic latent image formed on a latent image carrier. The system comprises a rotatable nonmagnetic sleeve, a magnetic roll mounted inside the sleeve, and a developer-limiting member made from a nonmagnetic material. The magnetic roll has neighboring magnetic poles which have the same polarity and repel each other. The limiting member is disposed opposite to the repelling magnetic poles and between the position at which the magnetic force produced by the repelling pole located on the upstream side as viewed in the direction of movement of developer is maximal and the position at which the magnetic forces produced between the repelling poles is minimal. Thus, the developing device is capable of forming a thin film of the developer without aging. The amount of the transferred developer depends to a lesser extent on the spacing between the sleeve and the limiting member.

3 Claims, 9 Drawing Sheets

DEVELOPING MAGNETIC ROLLER HAVING REPULSIVE MAGNETIC POLES AND DEVELOPER-LIMITING MEMBER

FIELD OF THE INVENTION

The present invention relates to a developing device used in a copier or printer which creates monochrome or color images and, more particularly, to a developing device that forms a thin layer of magnetic brush on a developing roll.

BACKGROUND OF THE INVENTION

A known developing device for forming a thin layer of magnetic brush on a developing roll is disclosed in Japanese Patent Laid-Open No. 43037/1979. In particular, this developing device has a sleeve incorporating a rotatable magnetic roll. A layer thickness-limiting member consisting of a magnetic substance is disposed over the sleeve such that a minute gap is maintained between them. Thus, a thin layer of magnetic brush is formed on the developing roll. Japanese Patent Laid-Open No. 43038/1979 discloses a method of forming a thin layer of magnetic brush by pressing a layer thickness-limiting member against a sleeve incorporating a rotatable magnetic roll. The limiting member is made of a resilient member. The present applicant has already proposed a method of limiting developer in Japanese Patent Laid-Open No. 203975/1985. Specifically, a magnetic roll producing repulsive magnetic fields is mounted inside a rotatable sleeve. The magnetic roll has magnetic poles which are located opposite to a limiting member and have the same polarity. Hence, the magnetic forces produced from these poles repel each other. The strength of the magnetic force at the exit of the limiting portion is made larger than the strength of the force at the entrance of the limiting portion. Japanese Patent Laid-Open No. 234177/1987 discloses a developing device in which magnets producing repulsive magnetic fields are mounted inside a rotatable sleeve. A limiting means has magnetic members disposed opposite to the magnets.

The method disclosed in the above-cited Japanese Patent Laid-Open No. 43037/1979 makes use of a monocomponent magnetic toner. A magnetic curtain is formed between the layer thickness-limiting plate and the magnetic poles of the magnetic roll to control the amount of magnetic toner transferred, or the thickness of the layer. The limiting plate consists of a magnetic member disposed immediately above and close to the magnetic poles of the magnetic roll. In this method, the amount of the transferred magnetic toner is affected greatly by the spacing between the magnets and the layer thickness-limiting plate and, therefore, the print quality is affected materially by the limiting plate itself and by the accuracy at which the plate is set up. Accordingly, in order to form a toner layer of a uniform thickness on the developing roll and to maintain high print quality, it is necessary to accurately set the spacing axially of the developing roll.

The method disclosed in the above-cited Japanese Patent Laid-Open No. 43038/1979 uses a monocomponent magnetic toner. The layer thickness-limiting member consisting of a resilient member is pressed against the sleeve incorporating the rotatable magnetic roll to control the amount of the transferred magnetic toner or the thickness of the layer. This method has the disadvantage that the amount of the transferred toner varies as the resilient member ages and wears down. As a result, the print quality is varied.

The present applicant's method disclosed in the above-cited Japanese Patent Laid-Open No. 203975/1985 exploits a monocomponent magnetic developer. The magnetic forces at the position opposite to the limiting member repel each other because of the same polarity. The strength of the magnetic force at the exit of the limiting portion is made larger than the strength of the magnetic force at the entrance. Thus, the developer is prevented from collecting on the upstream side of the flow of the developer. Also, nonuniform transfer of the developer is prevented at the time of trimming. Furthermore, when the chains of the developer particles are caused to stand by the repelling magnetic forces, the limiting member cuts the chains of the developer particles. Hence, the amount of the developer adhering to the sleeve can be reduced. However, the positional relation between the limiting member and the magnetic poles producing the repulsive magnetic fields is not taken into account in this method. Therefore, the amount of the developer adhering to the sleeve can increase, depending on this positional relation. This increase results in variations in the amount of transfer.

The method disclosed in the above-cited Japanese Patent Laid-Open No. 234177/1987 uses a dual component developer. A magnetic curtain is formed between the repulsive magnetic poles of the magnetic roll and the limiting member to obtain a uniform thin layer of toner. The limiting member has the magnetic member disposed immediately above and close to the magnetic poles. A region is formed in which the developer does not adhere to the sleeve to permit the developer to stay. Also, the passage of the developer or carrier is prevented. Only the toner is allowed to adhere electrostatically to the sleeve. Thus, the toner is carried. In this method, the force with which the toner adheres to the sleeve varies, depending on the triboelectricity produced between the sleeve and the toner. For this reason, the sleeve provides a quite small surface area for the toner. That is, the toner is unable to possess a sufficient amount of electric charge and so it is difficult to form a uniform layer of toner on the sleeve. Consequently, the homogeneity of the developed image concentration and variations in the concentration against background present problems. Also, where the spacing between the sleeve and the limiting member varies, the carrier particles easily flow out. As a result, the photoconductor is damaged mechanically in the development region. In addition, the carrier particles are developed together with the toner. In this case, white unprinted portions tend to occur. Where a uniform thin layer of developer is formed instead of forming only a layer of toner, it is necessary to accurately set the spacing axially of the developing roll, in the same way as in the method of the above-described Japanese Patent Laid-Open No. 43037/1979. Further, when the developer is conveyed, the thickness of the layer of the developer is limited while repeating the formation of the chains of the developer particles and the cutting of the developer particle chains. In consequence, the developer particle chains are not cut at a given location. In this way, the thickness of the layer of the developer is not uniform.

SUMMARY OF THE INVENTION

In view of the foregoing problems, it is an object of the present invention to provide a novel developing device which can form a thin film and does not age, and in which the amount of transferred developer depends to a lesser extent on the spacing between the sleeve and a developer-limiting member.

The above object is achieved in accordance with the teachings of the invention by a dual component developing device that uses both a magnetic carrier and a toner and has a rotatable nonmagnetic sleeve, a magnetic roll mounted inside the sleeve and possessing neighboring repulsive magnetic poles of equal polarity, and a developer-limiting member made from a nonmagnetic material and disposed opposite to the repulsive magnetic poles and between the position at which the magnetic force generated by the repulsive force lying on the upstream side as viewed in the direction of movement of the developer is maximal and the position at which the magnetic forces between both repulsive magnetic poles are minimal.

In the present invention, it is important that the developer-limiting member made from a nonmagnetic material be located in an opposite relation to the repulsive magnetic poles of the developing roll and between the position at which the magnetic force generated by the repulsive magnetic poles lying on the upstream side as viewed in the direction of movement of the developer assumes its maximum value and the position at which the magnetic forces between both repulsive magnetic poles assume their minimum value. The developing roll has the magnetic roll mounted inside the nonmagnetic sleeve. The developing roll can be polarized in any desired pattern except for the above-described repulsive magnetic poles for forming the layer.

Preferably, the developer-limiting member is disposed substantially midway between the position at which the magnetic force generated by the repulsive magnetic pole lying on the upstream side as viewed in the direction of movement of the developer is maximal and the position at which the magnetic forces between both repulsive magnetic poles are minimal. Also, it is desired to set the strength of the repulsive magnetic pole located on the upstream side as viewed in the direction of movement of the developer larger than the strength of the repulsive magnetic pole located on the downstream side.

In this way, the developer-limiting member made from a nonmagnetic material is disposed in an opposite relation to the repulsive magnetic poles of the developing roll and between the position at which the magnetic force generated by the repulsive magnetic pole lying on the upstream side as viewed in the direction of movement of the developer assumes its maximum value and the position at which the magnetic forces between both repulsive magnetic poles assume their minimum value. The developing roll has neighboring repulsive magnetic poles. of equal polarity inside the nonmagnetic sleeve. The repulsive magnetic fields created over the developing roll lower the packing density of the developer close to the repulsive fields. As the developing roll rotates, the developer is transferred while the thickness of the layer is being controlled by the developer-limiting member. Thus, the amount of the transferred developer can be reduced. As a result, the amount of the developer supplied onto the developing roll can be prevented from varying. Hence, the amount can be made constant. In addition, because the developer-limiting member made from a nonmagnetic material is disposed between the position at which the magnetic force produced by the repulsive magnetic pole located on the upstream side as viewed in the direction of movement of the developer takes its maximum value and the position at which the magnetic forces between the repulsive poles assume their minimum value, the limiting member is inevitably located in the position at which the magnetic force produced from the repulsive pole located on the upstream side as viewed in the direction of movement of the developer is decreasing toward the repulsive pole located on the downstream side. Therefore, a magnetic force acts on the developer located on the upstream side as viewed in the direction of movement of the developer to transfer the developer in the direction opposite to the direction of transfer of the developer. On the other hand, a magnetic force which forces the developer in the direction of movement of the developer hardly acts on the developer. Consequently, the force which causes the developer to pass through the gap between the limiting member and the developing roll hardly acts on this developer located immediately downstream of the limiting member; only the rotating force of the developing roll acts on the developer. In this way, the amount of the developer which passes through the gap between the limiting member and the developing roll as it turns can be prevented from varying if the spacing between the limiting member and the developing roll varies.

The operation of the novel developing device is described now. Since the developer-limiting member made from a nonmagnetic material is disposed in the repulsive magnetic fields in this way, a thin uniform layer of the dual component developer can be formed on the developing roll. This permits development at uniform print quality. The repulsive magnetic fields produced over the developing roll reduce the packing density of the developer near the repulsive magnetic fields. Under this condition, the spacing between the developing roll and the developer-limiting member made from a nonmagnetic material is set less than 1 mm. Consequently, the amount of the developer supplied onto the developing roll can be made small and uniform. The repulsive magnetic poles cause the developer to stay. The developer-limiting member is made nonmagnetic. For these reasons, particles of the developer do not form chains near the limiting member. Hence, the thickness of the layer of the developer is made uniform. The thickness of the layer of the developer depends to a lesser extent on the spacing between the sleeve and the limiting member. The thickness of the layer of the developer is controlled by the surface roughness of the sleeve, the moving speed of the sleeve, the position of the developer-limiting member relative to the repulsive magnetic poles, and the characteristics of the carrier such as the particle diameters of the carrier and the saturation magnetization.

In accordance with the present invention, the magnetic roll inside the rotatable developing sleeve is provided with the repulsive magnetic poles which are adjacent to each other and have the same polarity. The developer-limiting member made from a nonmagnetic material is disposed opposite to the repulsive magnetic poles and between the position at which the magnetic force produced by the repulsive magnetic pole located on the upstream side as viewed in the direction of movement of the developer assumes its maximum value and the position at which the magnetic forces between both repulsive magnetic poles take up their minimum value. In consequence, the dependence of the amount of the transferred developer on the spacing between the sleeve and the limiting member is reduced. In this way, a novel developing device which is capable of forming a thin layer and does not age is offered.

Other objects and features of the invention will appear in the course of the description thereof which follows.

DETAILED DESCRIPTION OF THE INVENTION

Figure 1:
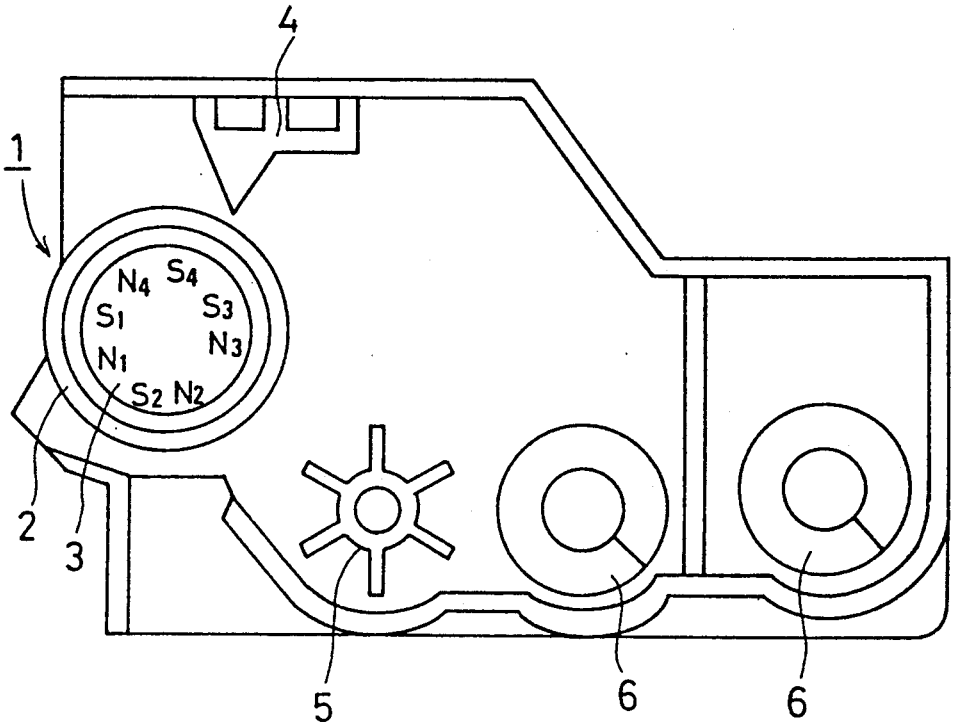
FIG. 1 is a schematic vertical cross section of a developing device according to the invention.
Figure 2:
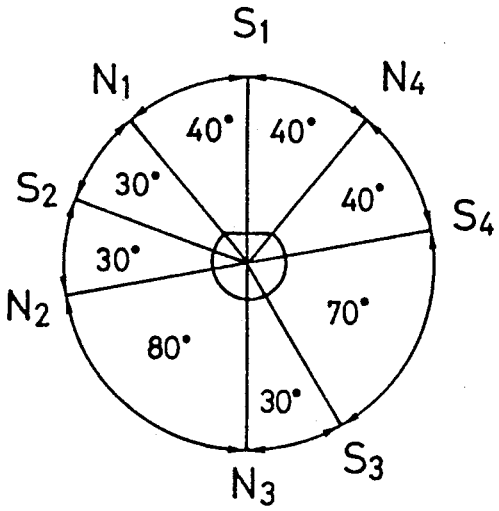
FIG. 2 is a schematic front elevation of the developing roll 3 of the developing device shown in FIG. 1.

Referring to FIG. 1, there is shown a developing device according to the present invention. This developing device consists principally of a developing roll 1, a developer-limiting member 4 made from a nonmagnetic material, a paddle 5, and augers 6. The developing roll 1 comprises a rotatable sleeve 2 made from a nonmagnetic material and a magnetic roll 3 mounted inside the sleeve 2. The average roughness of the surface of the sleeve 2 is 10 to 50 μm. The limiting member 4 is so mounted that the spacing between the sleeve 2 and the limiting member 4 is maintained constant. As shown in FIG. 2, the magnetic roll 3 is polarized in such a way that a developing magnetic pole $S_1$, peeling magnetic poles $N_2$ and $N_3$, and neighboring repulsive magnetic poles $S_3$ and $S_4$ of the same polarity form the fundamental magnetic poles of the magnetic roll. The peeling poles $N_2$ and $N_3$ act to peel the developer passed through a developing nip (not shown) off the sleeve 2. The repulsive poles $S_3$ and $S_4$ which neighbor each other act to form a thin layer of the developer. The developer-limiting plate 4 is spaced very close to the sleeve 2 between the repulsive magnetic poles $S_3$ and $S_4$. The paddle 5 serves to send the developer peeled off the sleeve by the peeling poles $N_2$ and $N_3$ toward the augers 6. The augers 6 stir the peeled developer. Also, the augers 6 act to stir the toner supplied from a toner hopper (not shown) and the developer contained in the developing device.

Figure 3:
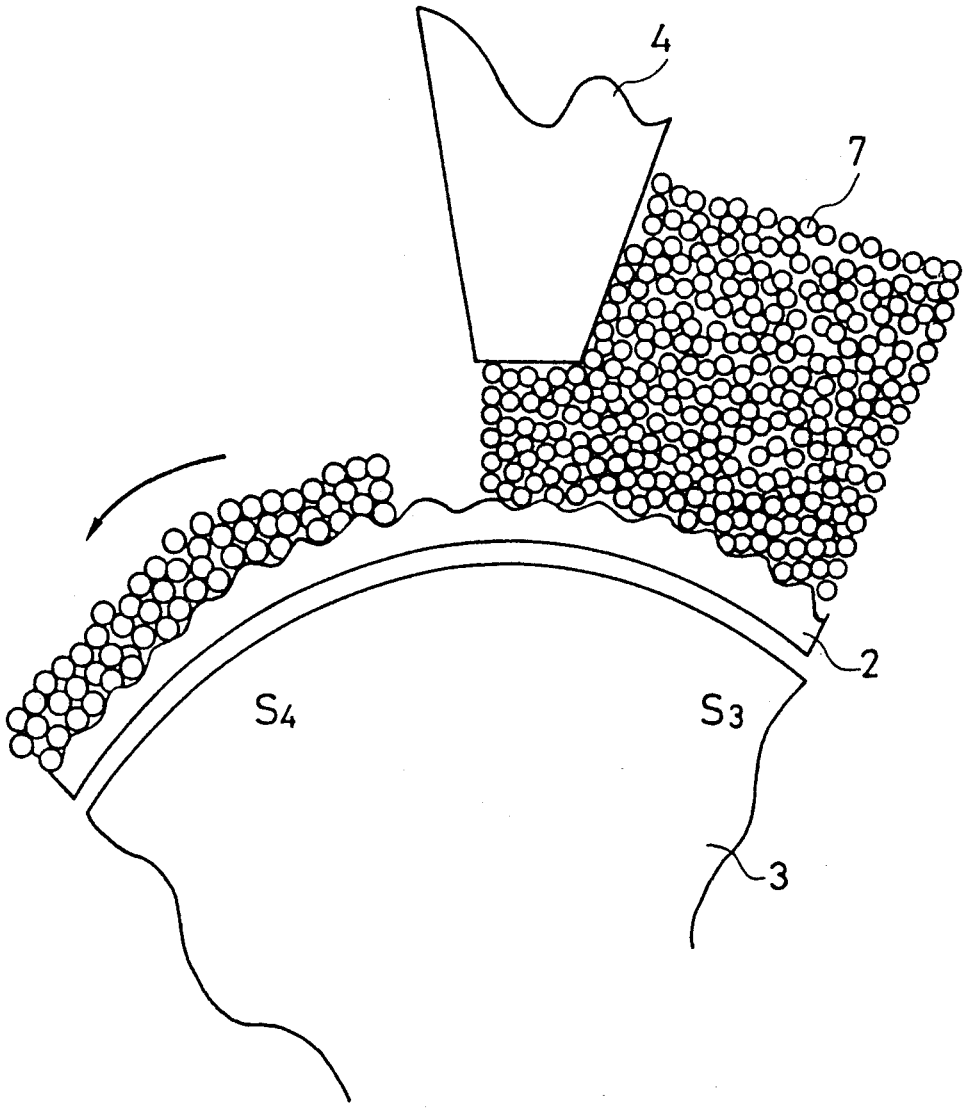
FIG. 3 is a pictorial view showing the manner in which a thin film is formed near the developer-limiting member of the developing device shown in FIG. 1.

FIG. 3 particularly shows the portion of the system of FIG. 1 which forms a thin layer of the developer. Repulsive magnetic fields are set up between the neighboring repulsive magnetic poles $S_3$ and $S_4$ of the same polarity. If the developer-limiting member 4 is absent, it is normally difficult to form a layer of the developer between these two poles. The limiting member 4 made from a nonmagnetic material is spaced a minute distance of 200 to 800 μm from the sleeve 2 between these repulsive magnetic poles. The sleeve 2 is rotated in the direction indicated by the arrow while the magnetic roll 3 is kept stationary. The developer which is attracted by the magnetic poles $N_3$ and $S_3$ of the magnetic roll 3 polarized as shown in FIG. 2 is conveyed toward the magnetic pole $S_4$. The developer 7 is collected behind the limiting member 4. As the sleeve 2 rotates, the developer also rotates while magnetically aligned around the magnetic pole $S_3$.

The developer enters the minute gap between the developer-limiting member 4 and the sleeve 2. As the sleeve 2 rotates, the recessed portions in the surface of the sleeve 2 convey the developer. As a result, only that portion of the the developer which is located in close proximity to the sleeve surface is moved toward the magnetic pole $S_4$. The moved developer forms a stable layer over the magnetic poles $N_4$ and $S_1$ according to the amount of the transferred developer. At this time, the portion of the developer other than said portion located in close proximity to the sleeve surface undergoes a force acting in the normal direction from the repulsive magnetic fields produced by the repulsive magnetic poles, and is pressed against the surface of the limiting member 4 opposite to the sleeve. Consequently, this portion of the developer cannot move.

The amount of transfer of the developer located in close proximity to the sleeve surface depends strongly on the roughness of the surface of the sleeve and also on the positional relation of the developer-limiting member 4 to the opposite magnetic poles $S_3$ and $S_4$. If the surface roughness of the sleeve is large, and if the limiting member 4 is located near the magnetic pole $S_4$, then the amount of the transferred developer is large. If the surface roughness of the sleeve is small, and if the limiting member 4 is situated close to the magnetic pole $S_3$, then the amount of the transferred developer depends on the spacing between the limiting member 4 and the sleeve 2, but the rate of change is small. The surface roughness of the sleeve varies, depending on the amount of transferred developer or on the height of the standing chains of developer particles, but is 10 to 50 μm, preferably 15 to 30 μm. The amount of the transferred developer is determined by various factors including the spacing between the developing roll and the photoconductor, the speed of the developing roll, the magnetic flux density of the magnetic roll, and the characteristics of the carrier such as particle diameters of the carrier and the magnetic characteristics. This is because a stable layer can be formed if the surface roughness of the sleeve is equal to or slightly less than the diameters of the particles of the used carrier. If the surface roughness is larger than the diameters of the carrier particles, then an excessive amount of developer is transferred. Conversely, if the surface roughness is smaller than the diameters of the carrier particles, then the developer is not transferred well.

The spacing between the developer-limiting member and the sleeve is determined by factors which are similar to the factors for the sleeve surface roughness. This spacing is 200 to 800 μm, preferably 400 to 600 μm. In order to improve the developing efficiency, it is desired to thin the layer, for increasing the strength of the developing electric field. However, when the accuracy at which the spacing is maintained is taken into account, the above-described range is appropriate. The magnetic flux density of the magnetic poles $S_3$ and $S_4$ is 400 to 1200 gauss, preferably 600 to 1000 gauss. It is possible that the magnetic forces produced from the magnetic poles $S_3$ and $S_4$ have gradient. If the magnetic flux density is too low, then less developer stays between the magnetic poles $S_3$ and $S_4$. Conversely, if the magnetic flux density is too high, then it is difficult to obtain a desired magnetic flux in imparting numerous magnetic poles to the magnetic roll. One example of the developer is a dual component developer consisting of a mixture of iron powder or a ferrite carrier and a toner. The surface of the ferrite carrier can be coated with a resin. Another example of the developer is a dual component developer consisting of a mixture of a carrier and a toner, the carrier comprising a resinous binder in which magnetic powder is dispersed.

In this embodiment, the developer-limiting member consisting of a nonmagnetic material is disposed opposite to the magnetic roll mounted inside the rotatable developing sleeve, the magnetic roll having the neighboring repulsive magnetic poles of equal polarity. The limiting member is located between the position at which the magnetic force of the repulsive magnetic pole lying on the upstream side as viewed in the direction of movement of the developer assumes its greatest value and the position at which the magnetic forces between the repulsive magnetic poles assume their minimum value.

More specifically, as shown in FIG. 3, the developer-limiting member 4 is disposed opposite to the repulsive magnetic poles $S_3$ and $S_4$ of the magnetic roll 3. The limiting member 4 is positioned between the position α at which the magnetic force of the repulsive magnetic pole located on the upstream side as viewed in the direction of movement of the developer is maximal and the position c at which the magnetic forces between the repulsive magnetic poles are minimal. Preferably, the limiting member 4 is at the point d located midway between these positions α and c. The line connecting the peak position of the magnetic force of the repulsive magnetic pole $S_4$ with the center of the developing roll is indicated by α. The line connecting the peak position of the magnetic force of the repulsive magnetic pole $S_4$ with the center of the developing roll is indicated by b. The angle made between the lines α and b is bisected by line c. The angle made between the lines b and c is bisected by straight line e. The magnitudes of the magnetic forces produced by the repulsive magnetic poles $S_3$ and $S_4$ of the magnetic roll 3 may be set equal to each other. In this embodiment, the magnetic force produced by the repulsive pole $S_3$ located on the upstream side as viewed in the direction of movement of the developer is set larger than the magnetic force produced by the repulsive pole $S_4$ placed on the downstream side.

Figure 4:
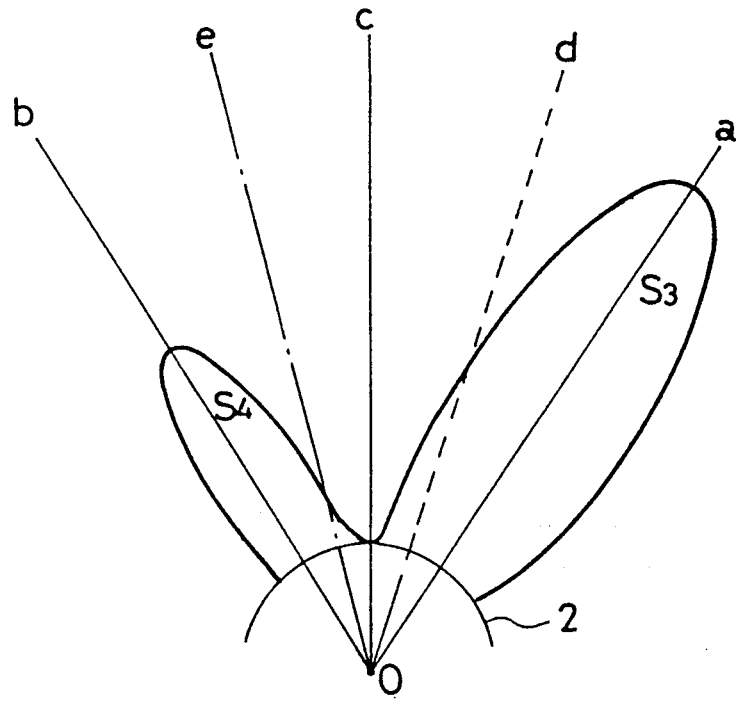
FIG. 4 is a diagram illustrating the distribution of magnetic force taken circumferentially of the developing roll near the repulsive magnetic poles of the developing device shown in FIG. 1.
Figure 5:
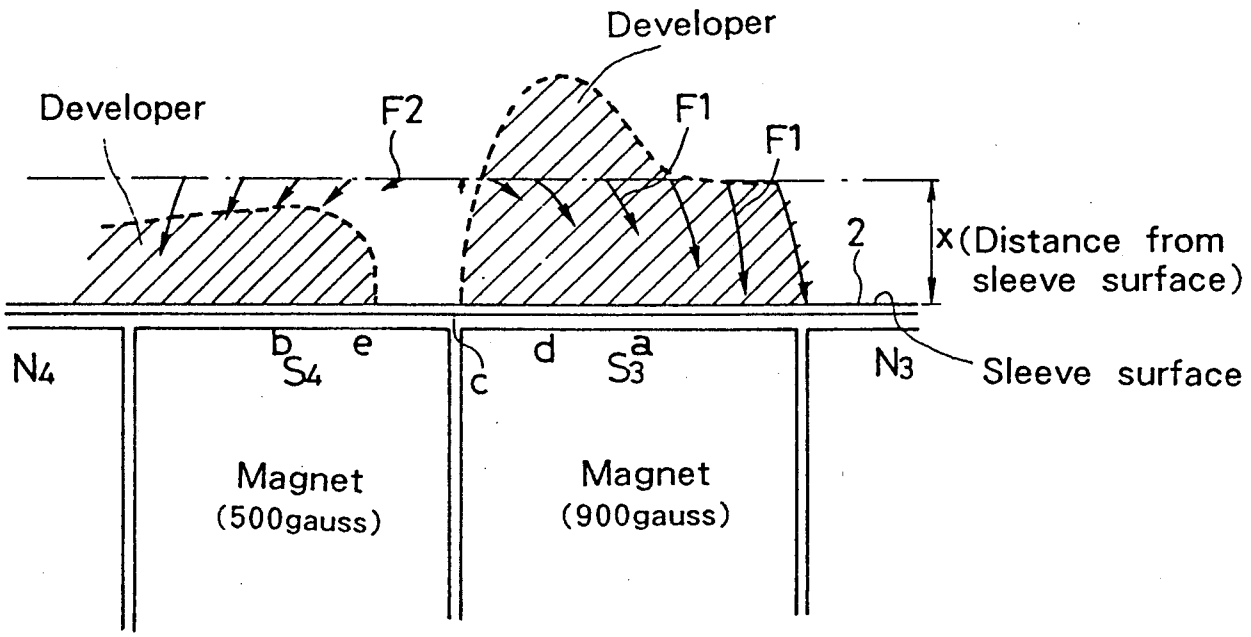
FIG. 5 is a diagram showing the manner in which developer is transferred near the repulsive magnetic poles of the magnetic roll of the developing device shown in FIG. 1.

In this way, in the above embodiment, the developer-limiting member 4 made from a nonmagnetic material is disposed opposite to the repulsive magnetic poles $S_3$ and $S_4$ of the developing roll 1 and between the position α at which the magnetic force produced by the repulsive magnetic pole $S_3$ located on the upstream side as viewed in the direction of movement of the developer assumes its maximum value and the position c at which the magnetic forces produced between the repulsive magnetic poles $S_3$ and $S_4$ assume their minimum value, as shown in FIG. 4. The repulsive poles $S_3$ and $S_4$ of equal polarity are adjacent to each other inside the nonmagnetic sleeve 2. The repulsive magnetic fields $S_3$ and $S_4$ created over the developing roll 1 lower the packing density of the developer close to the repulsive fields $S_3$ and $S_4$ as shown in FIG. 5. As the developing roll 1 rotates, the developer is transferred while the thickness of the layer is being controlled by the developer-limiting member 4. Thus, the amount of the transferred developer can be reduced. As a result, the amount of the developer supplied onto the developing roll 1 can be prevented from varying. Hence, the amount can be made constant.

In addition, because the developer-limiting member 4 made from a nonmagnetic material is disposed between the position α at which the magnetic force produced by the repulsive magnetic pole $S_3$ located on the upstream side as viewed in the direction of movement of the developer takes its maximum value and the position c at which the magnetic forces between the repulsive poles $S_3$ and $S_4$ assume their minimum value, the limiting member 4 is inevitably located in the position at which the magnetic force produced from the repulsive pole $S_3$ located on the upstream side as viewed in the direction of movement of the developer is decreasing toward the repulsive pole $S_4$ located on the downstream side. Therefore, a magnetic force F1 acts on the developer located on the upstream side as viewed in the direction of the developer as shown in FIG. 5 to thereby transfer the developer in the direction opposite to the direction of transfer of the developer. On the other hand, a magnetic force F2 which forces the developer in the direction of movement of the developer hardly acts on the developer located immediately downstream of the limiting member 4, i.e., $F2=0$. Consequently, the force which causes the developer to pass through the gap between the limiting member 4 and the developing roll 1 hardly acts on this developer located immediately downstream of the limiting member; only the rotating force of the roll 1 acts on this developer. In this way, the amount of the developer which passes through the gap between the limiting member 4 and the developing roll 1 as the roll 1 turns can be prevented from varying, depending on the variations in the spacing between the limiting member 4 and the roll 1. We give specific examples of the invention below.

EXAMPLE 1

Figure 6:
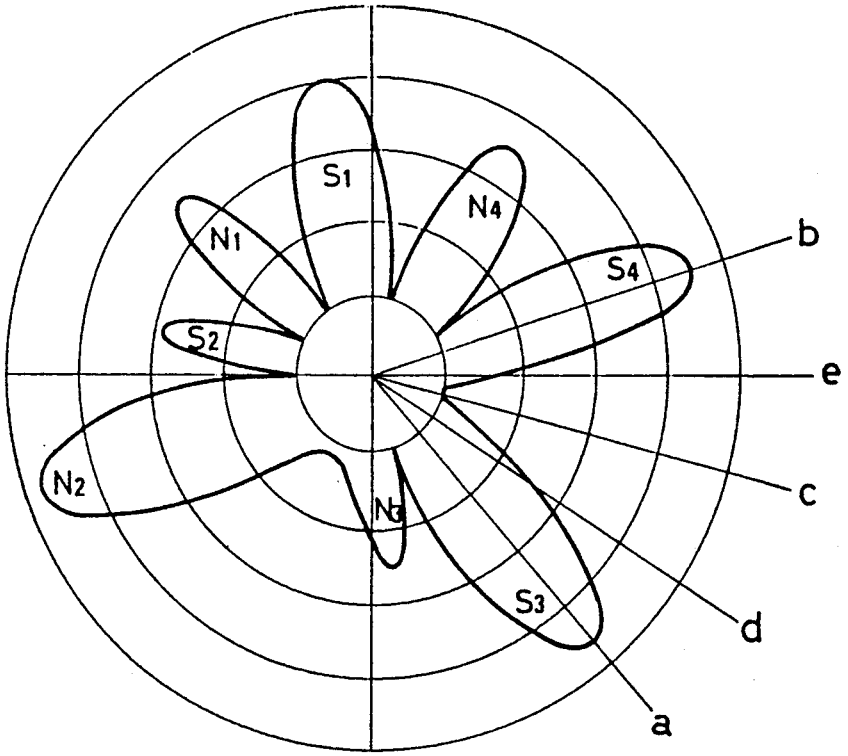
FIG. 6 is a diagram illustrating the distribution of magnetic force taken circumferentially of the magnetic roll of the developing device shown in FIG. 1.

The developing device shown in FIG. 1 comprised the developing roll 1 consisting of the nonmagnetic cylindrical sleeve 2 and the magnetic roll 3. The sleeve 2 had a surface roughness of 12.5 μm and an outside diameter of 24.5 mm. The magnetic roll 3 had 8 magnetic poles inside it. Of these poles, the developing magnetic pole $S_1$ had a magnetic flux density of 600 gauss. The repulsive magnetic poles $S_3$ and $S_4$ had a magnetic flux density of 900 gauss. The magnetic roll 3 was stationary, while the sleeve 2 was rotated. FIG. 6 shows the distribution of the magnetic force taken circumferentially of the developing roll 1. In this figure, as described above, the line connecting the peak position of the magnetic force of the repulsive magnetic pole $S_3$ with the center of the developing roll is indicated by α. The line connecting the peak position of the magnetic force of the repulsive magnetic pole $S_4$ with the center of the developing roll is indicated by b. The angle made between the lines $\alpha$ and b is bisected by line c. The angle made between the lines b and c is bisected by straight line e. The developer-limiting member was molded out of aluminum and located at the position c, i.e., substantially midway between the repulsive magnetic poles shown in FIG. 4. A toner having an average particle diameter of 11 μm was used as the developer. A magnetic powder-dispersed resin having a saturation magnetization of 40 emu/g and an average particle diameter of 45 μm was used as the carrier. The surface velocity of the developing roll was 390 mm/sec.

Under these conditions, the spacing between the developer-limiting member and the surface of the sleeve was set to 0.45 mm, 0.5 mm, and 0.55 mm. The amount, or the weight per unit area, of the transferred developer on the developing magnetic pole $S_1$ and the height of the chains of the developer particles were measured. An optical microscope was employed for the measurement of the height of the chains. For the above three values of the spacing between the limiting member and the sleeve surface, the amount of the transferred developer was 3.2 to 3.4 mg/cm$^2$, and the height of the chains was about 300 to 350 μm. That is, uniform layers of the developer having similar values were obtained.

EXAMPLE 2

Figure 7:
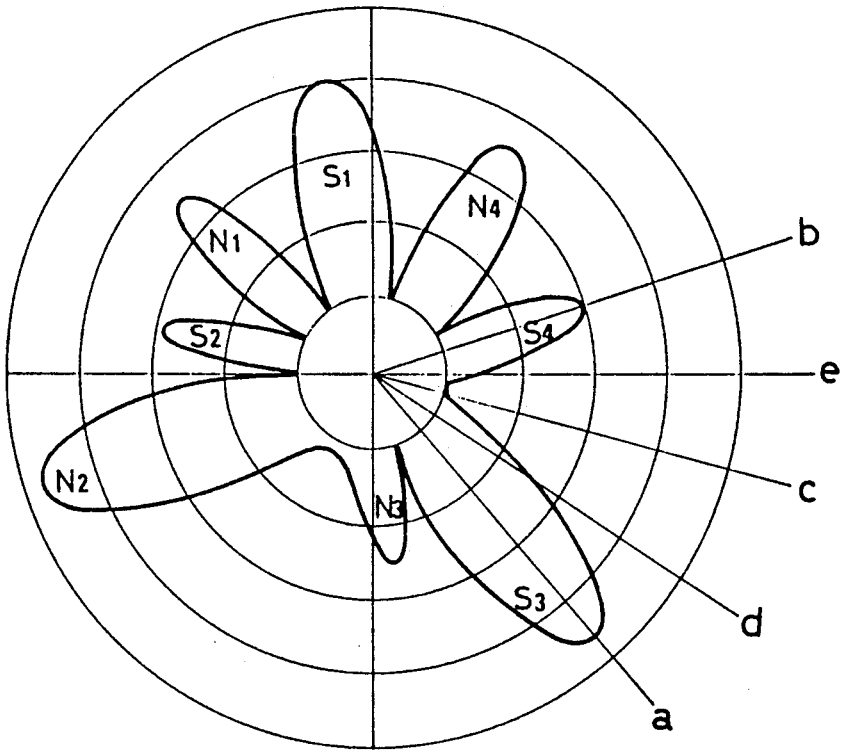
FIG. 7 is a diagram illustrating the distribution of magnetic force taken circumferentially of another developing roll according to the invention.

This example was similar to Example 1 except that the repulsive magnetic poles $S_3$ and $S_4$ of the magnetic roll 3 had magnetic flux densities of 900 gauss and 500 gauss, respectively. The spacing between the developer-limiting member and the surface of the sleeve was set to 0.45 mm, 0.5 mm, and 0.55 mm. The amount, or the weight per unit area, of the transferred developer on the developing magnetic pole $S_1$ and the height of the chains of the developer particles were measured. An optical microscope was employed for the measurement of the height of the chains. FIG. 7 shows the distribution of the magnetic force taken circumferentially of the developing roll 1. For the three values, i.e., 0.45 mm, 0.5 mm, and 0.55 mm, of the spacing between the developer-limiting member and the surface of the sleeve, the amount of the transferred developer was 3.4 mg/cm$^2$. The height of the chains of the particles was about 320 to 350 μm. That is, uniform layers of the developer having similar values were derived.

EXAMPLE 3

This example was similar to Example 2 except that two kinds of nonmagnetic cylinders each having an outside diameter of 24.5 mm were used as the sleeve 2 and that the spacing between the developer-limiting member 4 and the sleeve 2 was 0.5 mm. The surface roughness of one kind of cylinder was 6 μm, while the surface roughness of the other kind was 35 μm. The amount, or the weight per unit area, of the transferred developer on the developing magnetic pole $S_1$ and the height of the chains of the developer particles were measured. For the sleeve 2 having the surface roughness of 6 μm, the amount of transfer was 1.2 mg/cm$^2$, and the height of the standing chains of the particles was 80 to 120 μm. For the sleeve 2 having the surface roughness of 35 μm, the amount of transfer was 15 mg/cm$^2$, and the height of the standing chains of the particles was 900 to 950 μm. That is, uniform layers of the developer were obtained.

EXAMPLE 4

The developing device comprised the developing roll 1 consisting of the nonmagnetic cylindrical sleeve 2 and the magnetic roll 3 mounted inside the sleeve. The sleeve 2 had a surface roughness of 12.5 μm and an outside diameter of 24.5 mm. The magnetic roll 3 had 8 magnetic poles inside it. Of these poles, the developing magnetic pole $S_1$ had a magnetic flux density of 600 gauss. The repulsive magnetic poles $S_3$ and $S_4$ had magnetic flux densities of 900 gauss and 500 gauss, respectively. The magnetic roll 3 was stationary, while the sleeve 2 was rotated. The spacing between the developer-limiting member 4 molded out of aluminum and the surface of the sleeve 2 was set to 0.5 mm. The limiting member 4 was disposed at the position c located substantially midway between the repulsive magnetic poles shown in FIG. 4. A toner having an average particle diameter of 11 μm was used as the developer. A magnetic powder-dispersed resin having an average particle diameter of 45 μm and a saturation magnetization of 40 emu/g was employed as the carrier. A negatively charged photoconductor having an outside diameter of 84 mm was used. The process velocity was 130 mm/sec. At the position of the developing roll, the potential on image areas was −600 V, while the potential on nonimage areas was −100 V. The bias voltage applied for development comprised a direct current of −200 V on which an alternating current of 1.5 kV (peak-to-peak value) was superimposed. The frequency of the bias voltage was 3.0 kHz. The spacing between the photoconductor and the developing roll was 400 μm. The photoconductor and the developing roll were moved in the same direction. The surface velocity of the developing roll was three times as high as that of the photoconductor. In consequence, high-density and highly homogeneous images could be obtained. To perform a running test, 10,000 copies were created. Variations in the print quality and the surface roughness of the sleeve were measured. It was found that these were almost identical with those obtained at the beginning of the test. In this way, a thin uniform layer of the developer is formed on the developing roll. The layer is developed without making contact with the photoconductor. Thus, the photoconductor is prevented from getting mechanically damaged. Also, the photoconductor is prevented from vibrating. Furthermore, the spacing between the photoconductor and the developing roll can be made narrow, which contributes to an improvement in the print quality.

EXAMPLE 5

The positional relation of the developer-limiting member 4 to the opposite repulsive magnetic poles $S_3$ and $S_4$ was varied to measure the uniformity of the thickness of the layer, i.e., the easiness of the occurrence of variations in the developer layer thickness, and the dependence of the amount of transferred developer on the spacing between the limiting member 4 and the sleeve 2. The developing device comprised the developing roll 1 consisting of the nonmagnetic cylindrical sleeve 2 and the magnetic roll 3. The sleeve 2 had a surface roughness of 12.5 μm and an outside diameter of 24.5 mm. The magnetic roll 3 had 8 magnetic poles inside it. Of these poles, the developing magnetic pole $S_1$ had a magnetic flux density of 600 gauss. The repulsive magnetic poles $S_3$ and $S_4$ had magnetic flux densities of 900 gauss and 500 gauss, respectively. The magnetic roll 3 was stationary, while the sleeve 2 was rotated. The limiting member 4 was molded out of aluminum and placed at the positions α, b, c, d, and e. The spacing between the limiting member 4 and the sleeve 2 was set to 0.4 mm, 0.5 mm, and 0.6 mm. A toner having an average particle diameter of 11 μm was used as the developer. A magnetic powder-dispersed resin having an average particle diameter of 45 μm and a saturation magnetization of 40 emu/g was employed as the carrier. The surface velocity of the developing roll was 390 mm/sec. Variations in the height of the standing chains of the developer particles, taken axially of the developing roll were measured. The results are shown in FIG. 8.

Figure 8:
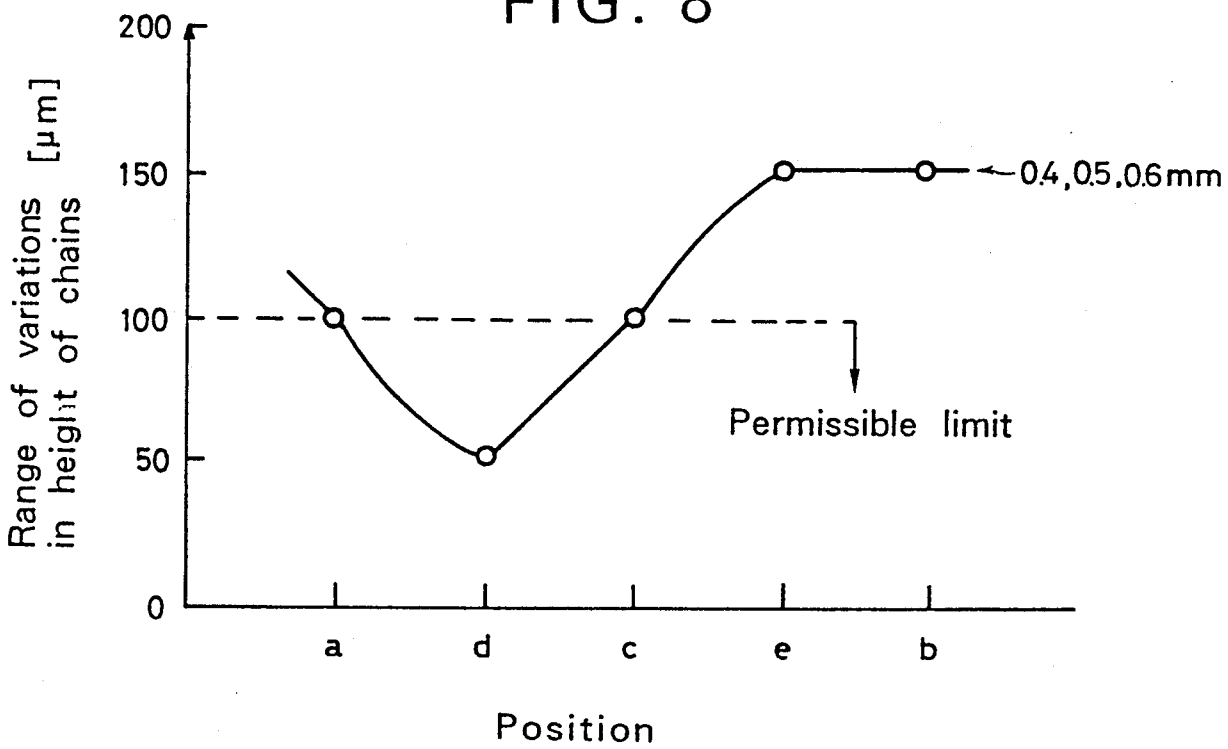
FIG. 8 is a graph showing the results of experiments, and in which the variations of the height of standing chains of developer particles are plotted against the distance, or position, of the developer-limiting member of the developing device shown in FIG. 1.

Referring to FIG. 8, where the range of the variations in the height of the standing chains of the developer particles was about 50 μm, the layer thickness was quite uniform. That is, nonuniformity of the developer layer thickness was suppressed quite satisfactorily. Also, where the range was about 100 μm, satisfactory results took place, and no practical problems occurred. On the other hand, where the range was about 150 μm, no practical problems did not take place, depending on the use conditions, but this is judged to be inappropriate from the degree of the homogeneity of the layer thickness. Therefore, for the three values, i.e., 0.4 mm, 0.5 mm, and 0.6 mm, of the spacing between the limiting member 4 and the sleeve 2, the thickness of the layer was uniform at the positions α, c, and d. Especially, at the position d, the layer thickness was stable against variations in the concentration of the toner.

Figure 9:
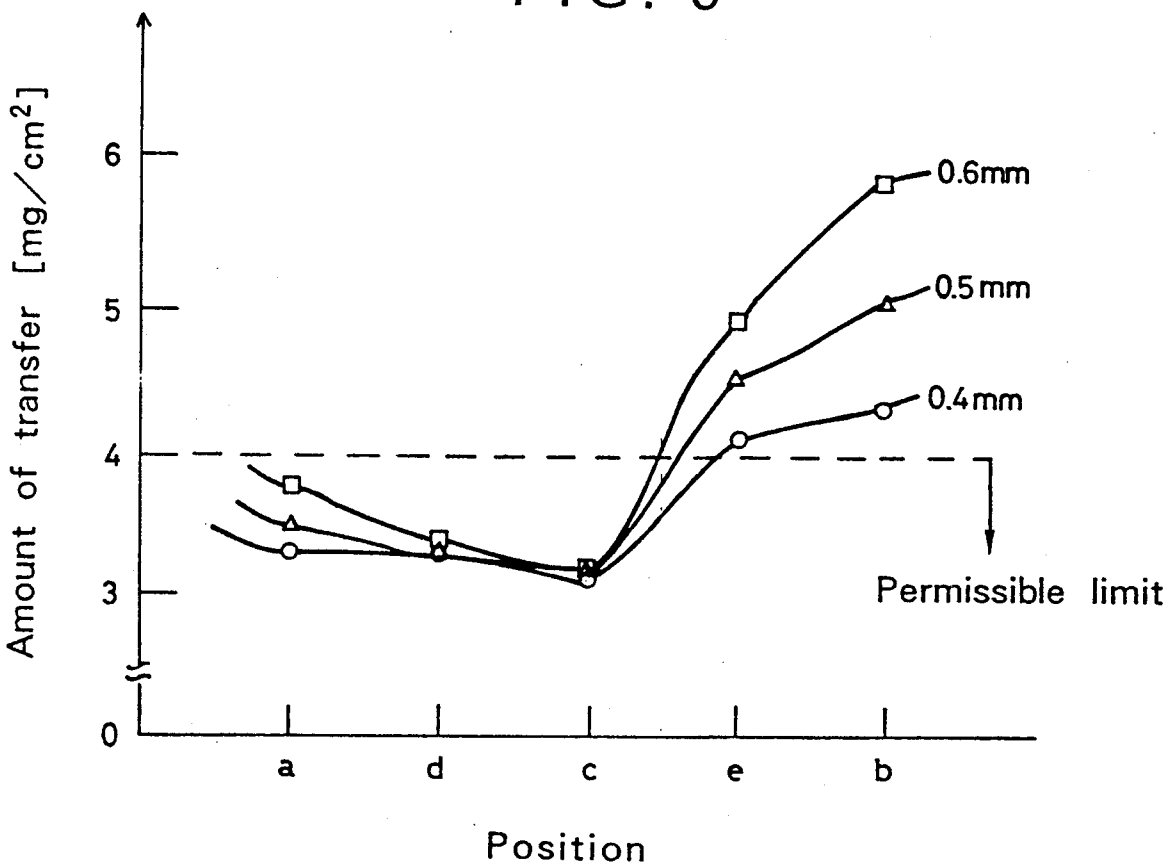
FIG. 9 is a graph showing the results of experiments, and in which the amount of transferred toner is plotted against the position of the developer-limiting member of the developing device shown in FIG. 1.

The dependence of the amount of the transferred developer at each position of the developer-limiting member on the spacing between the limiting member 4 and the sleeve 2 is shown in FIG. 9. At the positions b and e, the amount of the transfer depended much on the spacing. Also, the amount of transfer was larger. Especially, where the spacing between the limiting member 4 and the sleeve 2 was large, the tendency was conspicuous. At the positions α, c, and d, the dependence was small. Especially, at the position d, the amount of transfer was stable against variations in the spacing.

It can be said from the above-described results that where the developer-limiting member 4 opposite to the repulsive magnetic poles $S_3$ and $S_4$ is located at the position d, i.e., midway between the position α at which the magnetic force of the repulsive magnetic pole lying on the upstream side as viewed in the direction of movement of the developer is maximal and the position c at which the magnetic forces between both repulsive magnetic poles are minimal, the layer thickness is most stable against variations in the spacing between the limiting member 4 and the sleeve 2. Also, the amount of the transferred developer is most stable. The angle made between the lines α and b connecting the peak positions of the magnetic forces produced by the repulsive magnetic poles $S_3$ and $S_4$ with the center of the development roll is bisected by the line c. The angle between the lines c and α is bisected by the line d.

EXAMPLE 6

Figure 10:
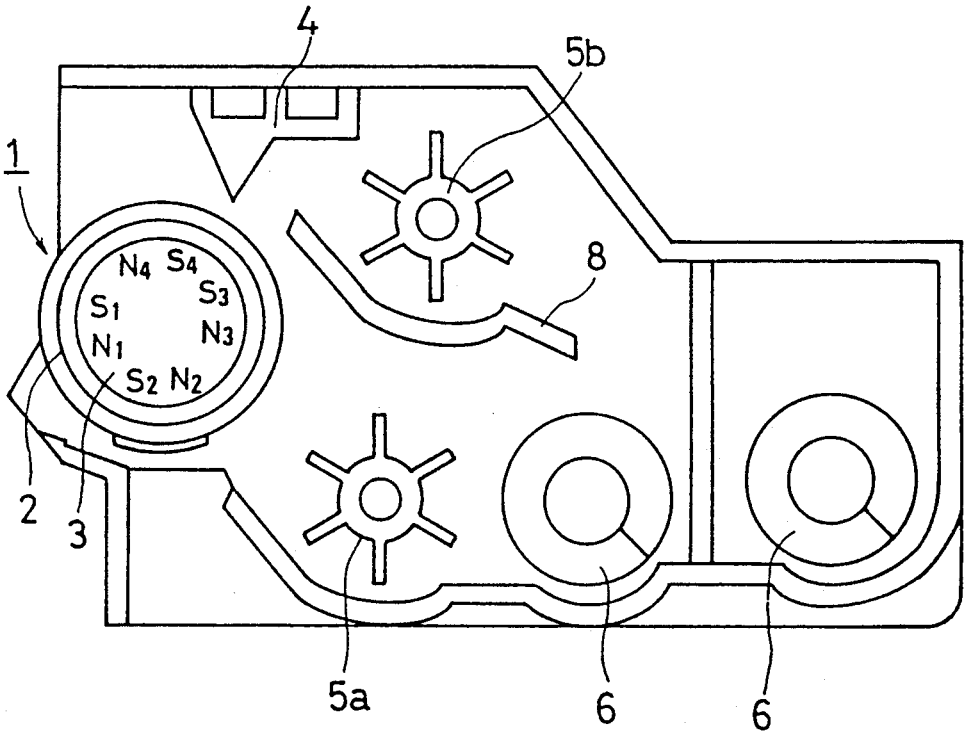
FIG. 10 is a view similar to FIG. 1, but showing a further developing device according to the invention.

As shown in FIG. 10, a guide member 8 and an upper paddle 5*b* were disposed behind the developer-limiting member 4 of the developing device. The upper paddle 5*b* is identical in shape with the paddle 5 shown in FIG. 1. The front end of the guide member 8 was placed between the repulsive magnetic poles $S_3$ and $S_4$ or over or near the repulsive pole $S_3$. The spacing between the front end of the guide member 8 and the surface of the sleeve was maintained at 3 mm. The upper paddle 5*b* acts to mechanically scrape out the developer collecting behind the limiting member, for preventing damage due to compression of the developer. Images were printed using this developing system under the same conditions as in Example 4. High-density images which were excellent in uniformity could be derived. The inside of the developing device, especially the condition of the developer behind the limiting member was observed while rotating the developing device. It was found that the developer was compressed to a lesser extent than the developer contained in the developing device of Example 4 shown in FIG. 1. We estimate that the guide member 8 acted as a preliminary developer-limiting member, thus causing the decrease in the compression together with the scraping of the developer by the upper paddle 5*b*. Since the upper paddle and the guide member are mounted behind the limiting member in this way, the mechanical stress in the developer contained in the developing device decreases, thus increasing the life of the developer. Furthermore, the formation of the uniform thin film is stabilized by the preliminary developer-limiting action. The pattern in which the magnetic roll is polarized is not limited to the pattern described in the embodiments but rather can be set at will except for the repulsive magnetic poles for forming a layer.

What is claimed is:

1. A dual component developing device for developing an electrostatic latent image formed on a latent image carrier, said developing device comprising:
   - a rotatable nonmagnetic sleeve;
   - a magnetic roll mounted inside said sleeve, said magnetic roll having repulsive magnetic poles of the same polarity disposed adjacent one another; and
   - a developer-limiting member formed from a nonmagnetic material, said developer-limiting member being disposed opposite to said repulsive magnetic poles and substantially midway between a position at which the magnetic force produced from one of said repulsive magnetic poles disposed upstream from the developer-limiting member relative to the direction of rotation of said sleeve is maximal and a position at which the sum of the magnetic forces produced by said repulsive magnetic poles is minimal.

2. A dual component developing device for developing an electrostatic latent image formed on a latent image carrier, said developing device comprising:
   - a rotatable nonmagnetic sleeve;
   - a magnetic roll mounted inside said sleeve, said magnetic roll having repulsive magnetic poles of the same polarity disposed adjacent one another; and
   - a developer-limiting member formed from a nonmagnetic material, said developer-limiting member being disposed opposite to said repulsive magnetic poles and between a position at which the magnetic force produced from one of said repulsive magnetic poles disposed upstream from said developer-limiting member relative to the direction of rotation of said sleeve is maximal and a position at which the sum of the magnetic forces produced by said repulsive magnetic poles is minimal, wherein the magnetic strength of the upstream repulsive magnetic pole is larger than the magnetic strength of one of said repulsive magnetic poles disposed downstream from said developer-limiting member.

3. The dual component developing device of claim 2, wherein said developer-limiting member is disposed substantially midway between said position at which the magnetic force produced from the upstream repulsive magnetic pole is maximal and said position at which the sum of the magnetic forces produced by said repulsive magnetic poles is minimal.

* * * * *